US005080144A

United States Patent [19]

Takehana

[11] Patent Number: 5,080,144

[45] Date of Patent: Jan. 14, 1992

[54] WEFT NOZZLE RETHREADING APPARATUS

[75] Inventor: Tatsuo Takehana, Matsuto, Japan

[73] Assignee: Tsudakoma Corp., Kanazawa, Japan

[21] Appl. No.: 584,572

[22] Filed: Sep. 18, 1990

[30] Foreign Application Priority Data

Sep. 18, 1989 [JP] Japan ..... 1-241542

[51] Int. Cl.[5] ..... D03D 47/34

[52] U.S. Cl. ..... 139/452; 139/116.2; 139/435.1

[58] Field of Search ..... 139/452, 450, 116.2

[56] References Cited

U.S. PATENT DOCUMENTS 4,969,489 11/1990 Tanaka et al. ..... 139/116.2
4,989,644 2/1991 Tanaka et al. ..... 139/116.2

FOREIGN PATENT DOCUMENTS 61-119746 6/1986 Japan .
62-62955 3/1987 Japan .
64-40638 2/1989 Japan .

*Primary Examiner*—Falik Andrew M.
*Attorney, Agent, or Firm*—Wenderoth, Lind & Ponack

[57] ABSTRACT

A weft insertion apparatus for inserting a weft yarn in a picking direction into a main picking nozzle of a picking apparatus of a loom, which nozzle has at least one individual nozzle, and the loom further having at least one measuring and storing device with a winding yarn guide. The insertion apparatus has an air current generator for generating an air current in the picking direction inside the at least one winding yarn guide, and a yarn suction device disposed at a position offset from the axis of the main picking nozzle and opposite an exit of the winding yarn guide positioned at a predetermined rotary position in the at least one measuring and storing device. It furthermore has a yarn conveying member for engaging a weft yarn extending between the at least one measuring and storing device and the yarn suction device and guiding the weft yarn thus engaged to the inlet end of the at least one individual nozzle of the main picking nozzle.

8 Claims, 11 Drawing Sheets

| | | SOLENOID VALVE | | | |
|---|---|---|---|---|---|
| | | 89 | 91 | 93 | 95 |
| SIGNAL REPRESENTATIVE OF THE KIND OF WEFT YARN | a | OFF | ON | ON | OFF |
| | b | ON | OFF | ON | OFF |
| | c | ON | OFF | OFF | ON |
| | d | OFF | ON | OFF | ON |

WEFT NOZZLE RETHREADING APPARATUS

BACKGROUND OF THE INVENTION

1. Field of the Invention

The present invention relates to an improvement of a weft insertion apparatus for inserting a weft yarn on a measuring and storing device into a main nozzle.

2. Prior Art

Prior art automatic weft insertion apparatuses of this type have been disclosed in Japanese Patent Laid-Open Publication Nos. 64-40638, 62-62955, 61-119746 and the like. Inasmuch as the usual prior art weft insertion apparatus has a weft insertion suction tube positioned over a storage drum, an insert rapier is restricted in its operation for retaining and conveying a weft yarn extending between a winding yarn guide and the suction tube, whereby an erroneous operation is liable to occur. Furthermore, inasmuch as the insert rapier moves near the measuring and storing device and moves to an inlet of the main nozzle, the amount of motion in the radial direction of the storage drum and the insertion direction is increased whereby the likelihood of a mechanical error in increased which results in an unstable insertion operation.

It has been proposed that an intermediate nozzle be provided between the main nozzle and the measuring and storing device and the weft yarn be once inserted from the winding yarn guide to the intermediate nozzle and thereafter air be jetted from the intermediate nozzle toward the inlet of the main nozzle to complete the weft yarn insertion. In this case, inasmuch as the weft yarn is picked, in a weaving operation, through the intermediate nozzle, the picking operation is liable to be unstable due to the internal resistance of the intermediate nozzle, and the weft yarn insertion operation, i.e., inserting the weft yarn by air from the intermediate nozzle to the main nozzle becomes unstable. That is, air is rebounded at the inlet of the main nozzle and is liable to generate turbulence which requires a special arrangement of the main nozzle to avoid. However, in view of the picking operation, it is undesirable to provide the special arrangement of the main nozzle and such an arrangement is difficult.

SUMMARY OF THE INVENTION

It is therefore an object of the present invention to provide a weft insertion apparatus capable of guiding the weft yarn on the measuring and storing device to a main picking nozzle with assurance.

To achieve the object of the present invention, the weft insertion apparatus of the present invention comprises an air current generator provided at the portion communicating with a winding yarn guide of a drum type measuring and storing device, a yarn suction device adjacent to the main picking nozzle, i.e. to the inlet of the main nozzle in confrontion relation with an exit of the winding yarn guide located at the prescribed rotary position, and a yarn conveying member for effecting reciprocal motion between the yarn suction device and the inlet of the main picking nozzle.

At the time of the weft insertion operation, the air current generator generates an air current inside the winding yarn guide in the weft yarn insertion direction to thereby disperse the internal weft yarn toward the inlet of the yarn suction device. During this time, the yarn suction device generates the air current in the drawing direction where the yarn suction device confronts the exit of the winding yarn guide to thereby draw a running weft yarn inside thereof. Thereafter, the yarn conveying member retains or grips the weft yarn adjacent to the yarn suction device and moves toward the main nozzle thereby guiding the weft yarn to the position adjacent to the inlet of the main nozzle. In this state, the main nozzle generates the air current in the picking direction so as to draw the weft yarn guided by the yarn conveying member thereinto so that the main nozzle is in a standby picking state.

According to the present invention as described above, inasmuch as the weft yarn is guided by the air current from the winding yarn guide to the yarn suction device, a mechanical guiding member for guiding the yarn is unnecessary, which simplifies the structure thereof. Furthermore, the yarn is not received by the main nozzle but received by the exclusive yarn suction device so that the yarn can be received together with the air current with assurance. Still furthermore, since the yarn is mechanically guided by the yarn conveying member from the yarn suction device to the main nozzle, the yarn is inserted with assurance and without erroneous operation.

With the arrangement of the present inventions set forth above, the following effects can be obtained.

Firstly, inasmuch as the arrangements of the insert rapier and the yarn suction device are simplified, the weft insertion apparatus can easily be put into practice.

Secondly, inasmuch as the insert rapier is operated linearly or in a circular arc in a simple repetitive operation, a complex guide mechanism is unnecessary so that the yarn insertion can be effected with assurance.

Thirdly, inasmuch as the weft yarn is guided by the air current generated by the air current generator from the winding yarn guide to the yarn suction device provided at the side of the main nozzle, the yarn insertion is quickly effected.

Fourthly, the weft yarn is not received by the main nozzle but received by the exclusive yarn suction device so that the weft yarn can be received by the exclusive yarn suction device with assurance.

Fifthly, the weft yarn insertion from the yarn suction device to the main nozzle is effected by the yarn conveying member, i.e. by the insert rapier and the yarn guide with the weft yarn being held mechanically, the weft yarn can be guided toward the inlet of the main nozzle with assurance and without erroneous operation.

Sixthly, since the yarn suction device and the yarn conveying member are respectively provided at the side of the main nozzle, the yarn suction device and the yarn conveying member can be utilized in common even in case of a multicolor loom.

The above and other objects, features and advantages of the present invention will become apparent from the following description taken in conjunction with the accompanying drawings.

PREFERRED EMBODIMENT OF THE INVENTION

First Embodiment (FIGS. 1-7)

A weft insertion apparatus according to a first embodiment of the present invention will be described with reference to FIGS. 1-7.

Figure 1:
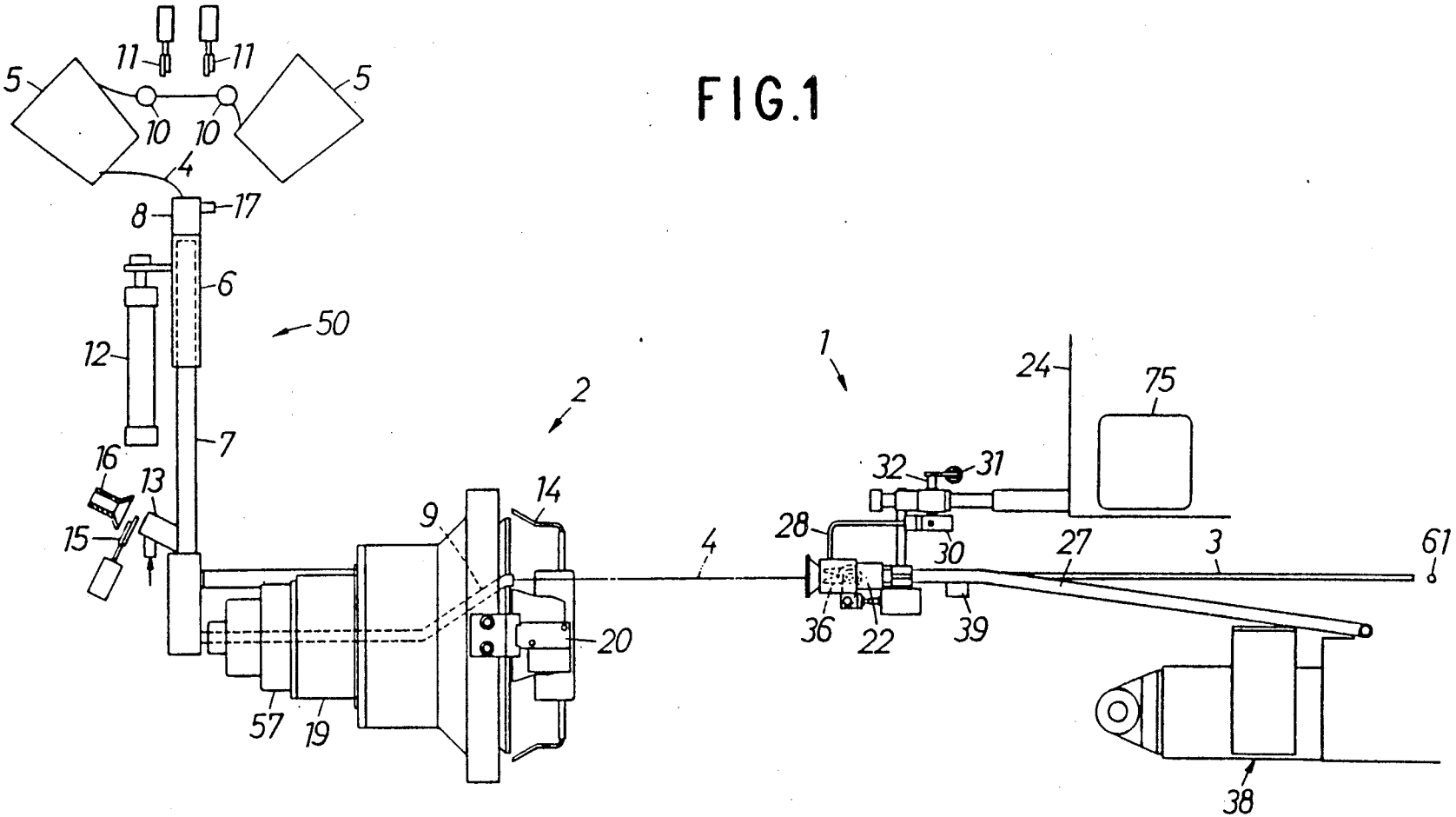
FIG. 1 is a plan view of a weft insertion apparatus according to a first embodiment of the present invention.
Figure 2:
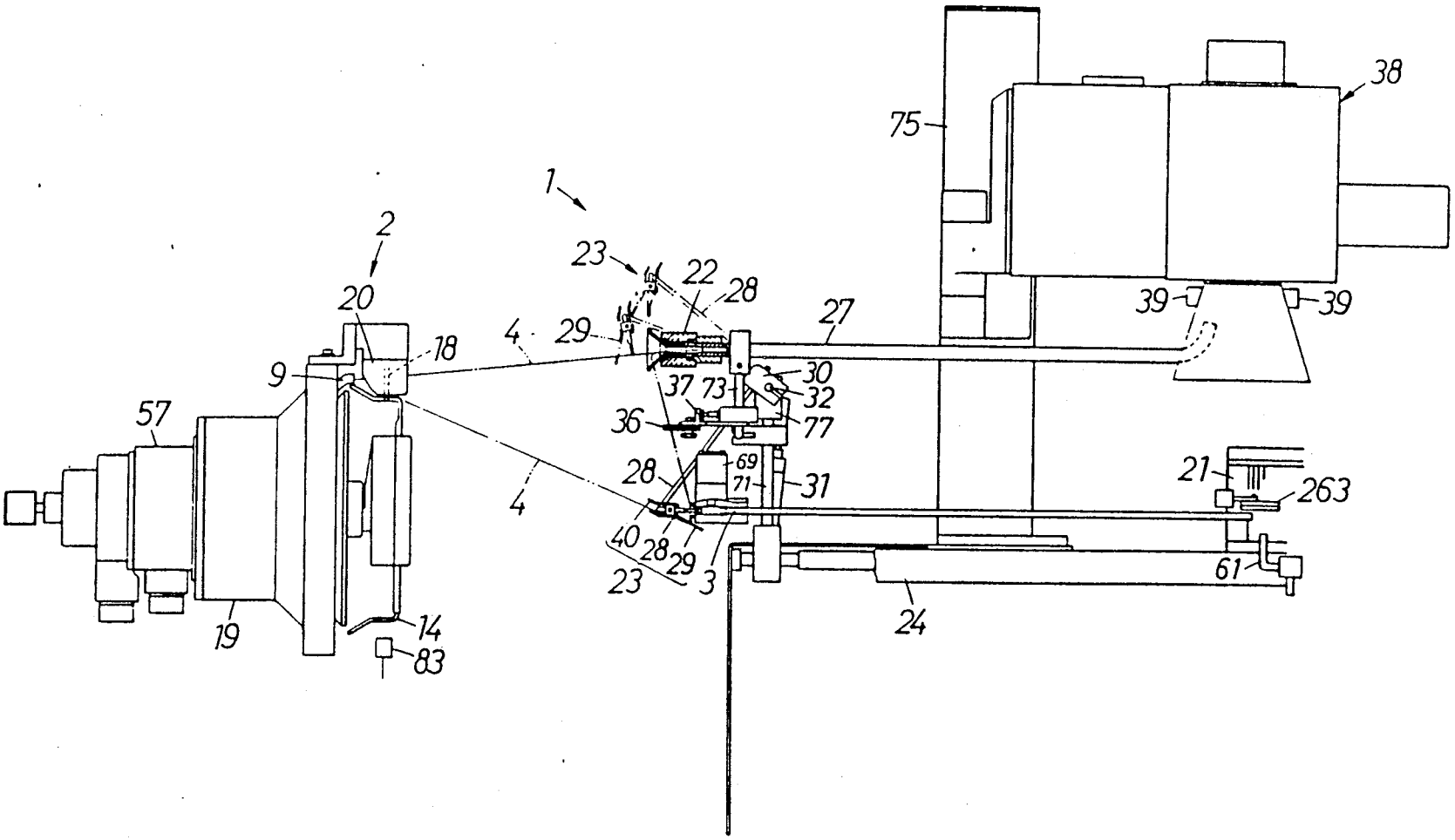
FIG. 2 is a side elevational view of the weft insertion apparatus of FIG. 1.
Figure 3:
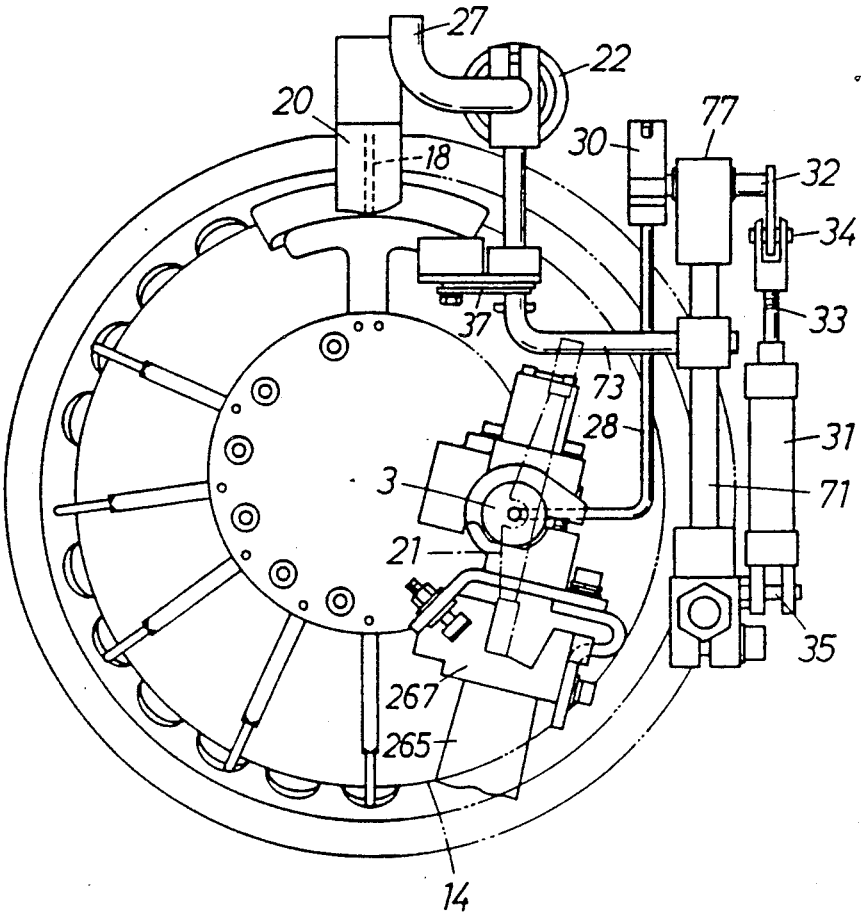
FIG. 3 is a front elevational view of the weft insertion apparatus of FIG. 1.

FIGS. 1-3 illustrate an arrangement of a weft insertion apparatus 1 in relation to a drum-type measuring and storing device 2 and picking nozzle 3.

There is provided a yarn guide device 50 composed mainly of guide tubes 6, 7 between the measuring and storing device 2 and the yarn packages 5.

A weft yarn 4 is supplied from one of the yarn packages 5 and travels inside the guide tubes 6, 7 and is guided into a winding yarn guide 9 of the measuring and storing device 2. A leading end of the weft yarn 4 supplied from one package 5 is connected to a tail end on the other package 5 and the weft yarn 4 is retained by two clampers 10 positioned between the yarn packages 5. The weft yarn 4 thus held by the two clampers 10 can be cut by two electromagnetic operation cutters 11.

One guide tube 6 of the two guide tubes 6, 7 of the yarn guide device 50 is inserted into an end of the other guide tube 7 and retractably movable by a pneumatic driving cylinder 12. An air current generator 8 is provided at the inlet end of the one guide pipe 6. The other guide pipe 7 is disposed so as to cross a central axis of a storage drum 14 of the measuring and storing device 2 and is connected to an inlet end of a rotary shaft portion of the winding yarn guide 9 and to a pullback nozzle 13. The pullback nozzle 13 is provided for generating an air current inside the winding yarn guide 9 in the pullback direction so as to pull back the weft yarn 4 from the storage drum 14. When the weft yarn 4 remaining on the measuring and storing device 2, i.e. the weft yarn 4 remaining on the storage drum 14, is removed the yarn is broken between the measuring and storing device 2 and the main nozzle, which requires stoppage of the loom. The weft yarn 4 on the storage drum 14 is removed by the cooperation of the pullback nozzle 13 and a retracting motion of a retaining pin 18 away from the circumference of the storage drum 14 and a predetermined rotary motion of the winding yarn guide 9 at low speed in the direction opposite to the winding direction.

Figure 12:
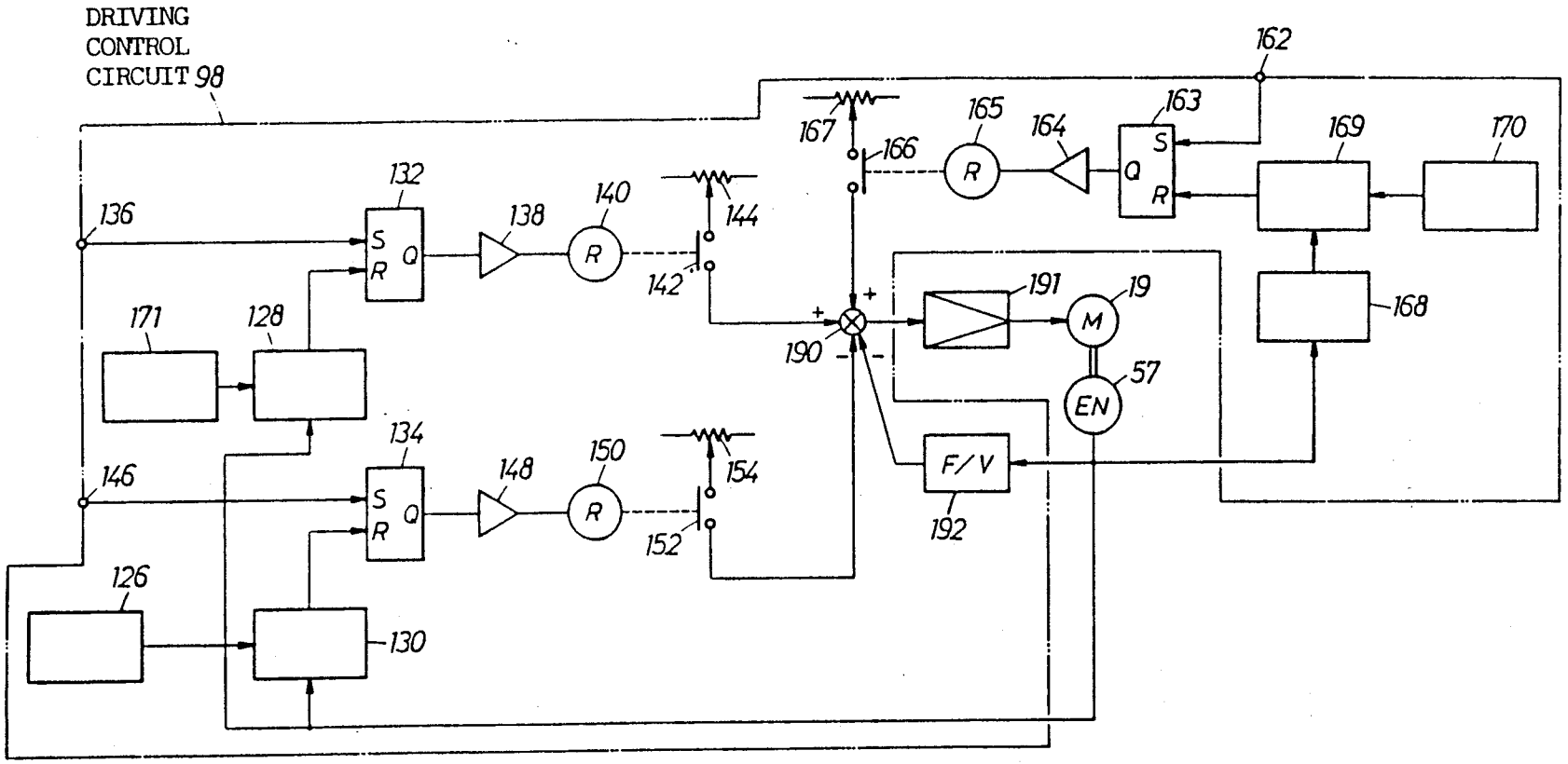
FIG. 12 is a block diagram of a driving control circuit for a yarn guide motor.

The rotary motion of the winding yarn guide 9 is controlled by a driving control circuit 98 of a motor 19 as illustrated in FIG. 12. That is, when the weft yarn 4 is removed from the drum 14, the driving control circuit 98 sets a flip-flop 134 when an operation instruction is applied to an input terminal 146 whereby a contact 152 is closed by a driver 148, and a relay 150 is actuated so that the motor 19 is rotated by a driving amplifier 191 in the direction opposite to the winding direction of the weft yarn 4 at a rotating speed set by a setting unit 154. A counter 130 receives rotary pulse signals from an encloder 57 connected to a rotary shaft of the motor 19. The driving control circuit 98 resets the flip-flop 134 when the number of rotary pulse signals reaches a predetermined value set by a setting unit 126, whereby the rotary motion of the motor 19 stops. The rotary pulse signals from the encoder 57 are converted to a voltage by an F/V converter 192 and applied to an adding point 190 as a feedback signal. A leading end of the weft yarn 4, after it is pulled back, is cut by an electromagnetic cutter 15 and discharged from a discharge pipe 16 to a prescribed position. Since the pullback nozzle 13 is kept in operation after the weft yarn 4 is cut off, the cut end of the weft yarn 4 from the yarn package 5 is held inside the pullback nozzle 13.

When the weft yarn 4 supplied from the yarn package 5 is cut between the yarn package 5 and the measuring and storing device 2, the broken state is detected by a yarn detector 17 at a portion, e.g. of the guide tube 6 or the guide tube 7 and the loom is thereby caused to stop. Thereafter, a blowing nozzle 61 and the main nozzle 3 jet air under pressure so as to remove the piece of weft yarn 4 extending from the storage drum 14 on the other side of the break. A suction device in a weft yarn removal device 38 for removing cut off leading ends of the weft yarn is operated and a retaining pin 18 is retracted from the circumference of the storage drum 14. As a result, the weft yarn 4 on the other side of the break is diverted from the main nozzle 3 and is discharged into the weft yarn removal device 38. When a yarn detector 39 provided in the improper yarn removal device 38 provides a signal indicating no yarn is present, a blowing nozzle 61, the main nozzle 3 and the removal device 38 respectively stop their operations. A cylinder 12 advances the guide tube 6 to thereby move the inlet end of the guide tube 6 to a position adjacent to the weft yarn 4 positioned in the intermediate position between the two clampers 10. At the same time, the air current generator 8 generates air current inside the guide tubes 6, 7 and the winding yarn guide 9 in the drawing direction. Then, a cutter 11 cuts the weft yarn 4 between two clampers 10. Hence, a new leading end of the next yarn package 5 is drawn inside the guide pipe 6 together with an air current, and the weft yarn 4 from the next yarn package 5 is removed from the clamper 10 by the release of the clamper 10 or by a strong suction caused by the air current. The weft yarn 4 is then drawn into the guide tubes 6, 7 and finally guided inside the winding yarn guide 9. The operations set forth above are sequentially effected by a controller (not shown).

The drum type measuring and storing device 2 winds and measures the weft yarn 4 on the circumference of the stationary storage drum 14 by the rotary motion of the winding yarn guide 9 while the weft yarn 4 is retained by the retaining pin 18, and thereafter stores the weft yarn on the storage drum 14. The winding yarn guide 9 is tubular and supported in the central axis of the storage drum 14 driven by the motor 19. The retaining pin 18 is driven by a solenoid 20 to thereby move toward the circumference of the storage drum 14 and retain the weft yarn 4 on the storage drum 14 when the measuring and storing operation is performed, and the retaining pin 18 withdraws in the picking phase to thereby release the weft yarn 4, which is stored on the measuring and storing device 2 after the measurement, from the storage drum 14, whereby the weft yarn 4 is ready for picking.

The main picking nozzle 3, when a picking phase solenoid valve 69 directly connected thereto is opened to release picking fluid thereinto, draws the released weft yarn 4 into the picking fluid, thereby jetting the weft yarn 4 together with the picking fluid along the guide of a reed 21 for picking the weft yarn 4 into a shed of warp yarn. The main picking nozzle 3 is fixed with the reed 21 on a reed holder 267 which is mounted on a slay sword (see FIG. 3). The main picking nozzle 3 performs a swinging motion in synchronism with the motion of the loom.

The weft insertion apparatus 1 according to the first embodiment of the present invention is composed of the air current generator 8, a yarn suction unit 22, a yarn conveying member 23 and a cutter 36.

Figure 4:
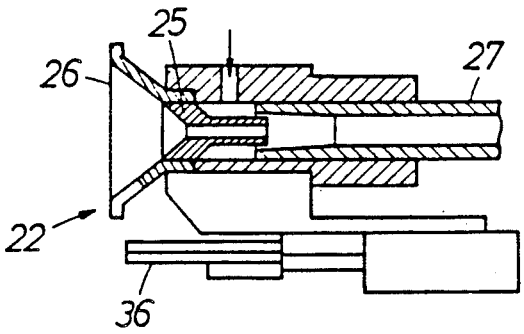
FIG. 4 is a cross sectional view of a yarn suction device employed in the weft insertion apparatus of FIG. 1.
Figure 5A:
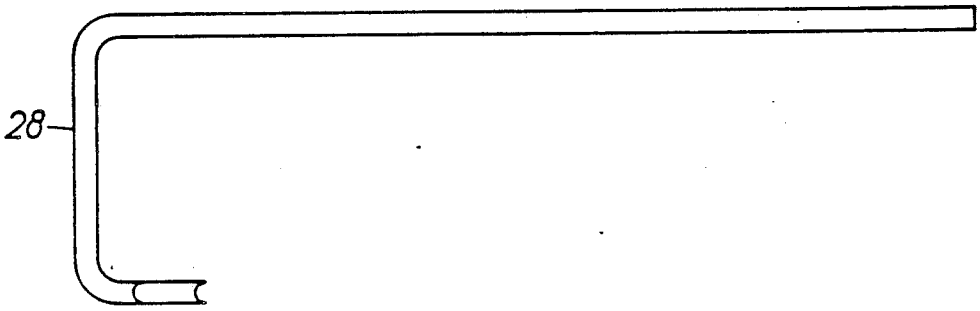
FIG. 5*a* is an enlarged side elevational view of an insert rapier employed in the weft insertion apparatus of FIG. 1.
Figure 5B:
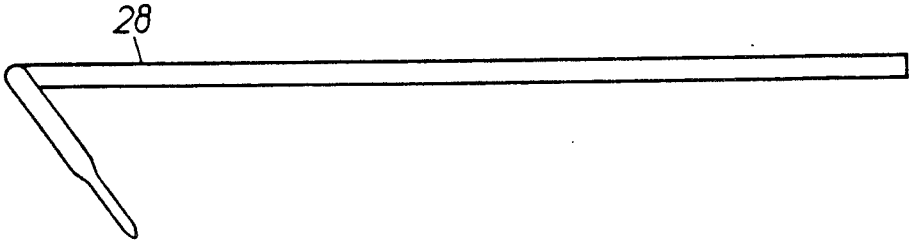
FIG. 5*b* is a plan view of the insert rapier of FIG. 5*a;*
Figure 6:
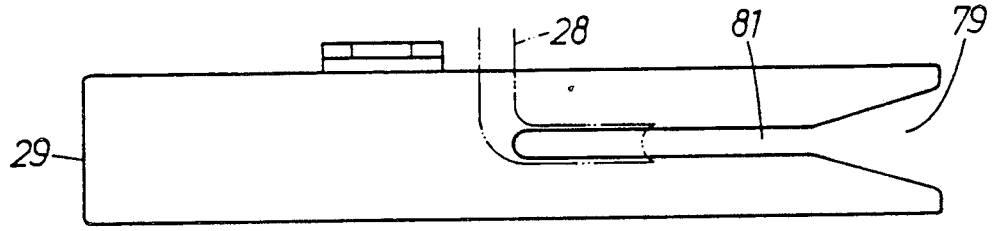
FIG. 6 is an enlarged plan view of a yarn guide employed in the weft insertion apparatus of FIG. 1.
Figure 7:
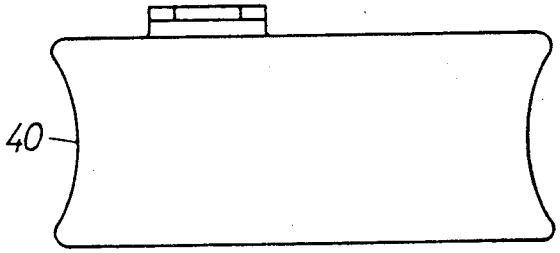
FIG. 7 is a plan view of a yarn slope employed in the weft insertion apparatus of FIG. 1.

The air current generator 8 provides an air current not only in the guide tube 6 but also in the guide tube 7 and the winding yarn guide 9 for generating air current inside the winding yarn guide 9 in the yarn insertion direction of the weft yarn 4. The yarn suction device 22 is opposed to the outlet of the winding yarn 9 when it is stopped and in the disclosed embodiment is attached to the frame 24 over the main picking nozzle 3 on supporting shafts 71, 73 and is composed of a suction nozzle 25, a trumpet-shaped guide body 26 provided at the suction end of the suction nozzle 25 and a discharge pipe 27 provided at the discharge end of the suction nozzle 25 as illustrated in FIGS. 1 and 4. A tip end of the discharge pipe 27 is positioned adjacent to the yarn inlet portion of the yarn leading end removal device 38 mounted on the frame 24 by a stay 75. The yarn conveying member 23 retains the weft yarn 4 extending between the winding yarn guide 9 and the yarn suction device 22 and guides the weft yarn 4 from the yarn suction device 22 to the inlet end of the main nozzle 3. The yarn conveying member 23 comprises an insert rapier 28 as illustrated in FIGS. 5*a* and 5*b*, a forked shaped yarn guide 29 attached to the tip end of the insert rapier as illustrated in FIG. 6, a supporting body 77 rotatably supporting the insert rapier 28 and the yarn guide 29 on an arm 30, a fulcrum shaft 32 and a fluid driven piston-cylinder 31. The arm 30 is rotatably supported by the supporting body 77 which is fixed to the supporting shaft 71 by the fulcrum shaft 32. The arm 30 holds the insert rapier 28 and the yarn guide 29 and is connected to a piston rod 33 of the cylinder 31 by a pin 34 at the rear end thereof by the fulcrum shaft 32. The cylinder 31 is rotatably supported at the rear end thereof by a supporting shaft 35 on the frame 24. Hence, the yarn conveying member 23 is movable by rotation thereof from the front side of the yarn suction device 22 to the inlet side of the main nozzle 3. There is also provided a solenoid operated cutter 36 as illustrated in FIG. 2 mounted on the supporting shaft 73 by a bracket 37. Alternatively, the solenoid operated cutter 36 can be attached to the portion adjacent to a side of the yarn suction device 22 as illustrated in FIG. 4. There is provided a yarn shield 40, as shown in FIG. 7, at a position adjacent to the insert rapier 28 so that the weft yarn 4 extended from the cutter 36 to the main nozzle 3 is not entangled with the weft yarn 4 extending from the storage drum when the weft yarn is cut between the main nozzle 3 and the yarn suction device 22.

In the initial yarn insertion operation, or the yarn insertion operation after breakage of the weft yarn 4, the winding yarn guide 9 is always positioned in confronting relation with the yarn suction device 2 so as to be ready for the weft insertion operation. That is, the controller (not shown) provides an instruction signal to an input terminal 162 of the driving control circuit 98 after the loom is stopped. At this time, the winding yarn guide 9 has stopped at an arbitrary position simultaneously with the stoppage of the loom. A flip-flop 163, upon reception of the instruction signal, is set and a contact 166 is closed by a driver 164 to actuate a relay 165 so that the motor 19 is rotated at the speed set by a setting unit 167. A converter 168 receives a pulse signal from the encoder 57 and converts the pulse signal into a rotary angle signal which is provided to the comparator 169. The comparator 169 provides a signal to the flip-flop 163 when an output of the converter 168 coincides with a predetermined rotary angle set by a setting unit 170 whereby the flip-flop 163 is reset to stop the rotary motion of the motor 19. The yarn conveying member 23 remains stopped at a standby position by the cylinder 31.

When the weft yarn is broken, the controller (not shown) operates as described earlier and thereafter the air current generator 8 generates an air current inside the winding yarn guide 9 in the yarn insertion direction so that the weft yarn 4 inside the guide tubes 6, 7 is inserted into the winding yarn guide 9 and is jetted from the top end thereof so as to extend into the yarn suction device 22. Whereupon, the yarn suction device 22 generates an air current by the suction nozzle 25 in the yarn insertion direction during the picking operation. Furthermore, the suction unit of the yarn removal device 38 starts a suction operation. Accordingly, the weft yarn 4 flies out of the exit of the tip end of the winding yarn guide 9 and travels toward the yarn suction device 22 and is introduced into the inside of the discharge pipe 27 by the air current in the yarn suction device 22 through the inside of the suction nozzle 25. The existence of the weft yarn 4 inside the discharge pipe 27 is detected by the yarn detector 39 at the inside of the yarn removal device 38 or the inside of the discharge pipe 27.

After detection of the presence of the weft yarn 24, the air current generator 8 stops and the cylinder 31 actuates so that the insert rapier 28, the yarn guide 29 and the yarn shield 40 of the yarn conveying member 23 are respectively rotated about the fulcrum shaft 32 so that the insert rapier 28 is moved from the standby position to the inlet side of the main nozzle 3. When the yarn guide 29 is moved to the position on the axial line of the suction nozzle 25, the weft yarn 4 extended from the winding yarn guide 9 to the suction nozzle 25 is positioned inside a guide introduction opening 79 of the yarn guide 29 and thereafter guided to an introduction groove 81 defined at the center of the yarn guide 29 during the movement of the yarn guide 29. At this time, the weft yarn 4 is retained by the tip end portion of the insert rapier 28 disposed in parallel with the introduction groove 81 at the same position and the retained weft yarn 4 is moved to the inlet of the main nozzle 3. At this time, the weft yarn 4 is pulled back from the discharge pipe 27 and guided toward the inlet side of the main nozzle 3.

In this state, the retaining pin 18 of the measuring and storing device 2 advances toward the circumference of the storage drum 14, thereafter the winding yarn guide 9 is rotated by the prescribed amount to thereby wind the weft yarn 4 preliminarily on the storage drum in the necessary amount. That is, when the insert rapier 28 reaches the inlet of the main nozzle 3, the instruction signal is provided from the controller to an input terminal 136 of the driving control circuit 98 so that a flip-flop 132 is set and a contact 142 is closed by a driver 138 and a relay 140 whereby the motor 19 is rotated at the speed set by a setting unit 144. When the motor 19 is rotated the amount prescribed by a setting unit 171, a counter 128 resets the flip-flop 132 so that the motor 19 is stopped. Thereafter, when the air current is generated inside the main nozzle 3 in the picking direction by the actuation of the solenoid valve 69, the weft yarn 4 guided by the insert rapier 28 and the yarn guide 29 is drawn inside thereof. Thereafter, the cutter 36 is actuated to cut the weft yarn 4 between the yarn suction 22 and the yarn conveying member 23. After the weft yarn 4 is cut, the weft yarn 4 extended from the winding yarn guide 9 to the main nozzle 3 is not entangled with the cut off leading end due to the existence of the yarn shield 40. Thus, the cut end of the weft yarn 4 is easily guided to the inside of the main nozzle 3 and inserted into the main nozzle 3. The cut off leading end of the weft yarn 4 inside the discharge pipe 27 is drawn into the yarn removal device 38 by the air current and discharged to a prescribed position.

At the same time, the retaining pin 18 is retracted from the circumference of the storage drum 18 and when a release detector 83 provided at a position adjacent to the storage drum 14 detects the number of windings, e.g. two windings of the weft yarn released from the storage drum 14, the retaining pin 18 advances to the circumference of the storage drum 14. The leading end of the weft yarn 4 inserted into the main nozzle 3 by the already actuated blowing nozzle 61 is guided into the suction opening of the yarn removal device 38. When the yarn detector 39 detects the presence of the weft yarn 4, a cutter 263 is actuated to cut a further leading end portion of the weft yarn 4 at the tip end of the main nozzle 3. Thereafter, the yarn suction device 22, the suction unit of the yarn removal device 38 and the main nozzle 3 are respectively stopped and the insert rapier 28 returns to the standby position.

The preliminary winding operation can be effectd when the weft yarn 4 has been extended between the winding yarn guide 9 and the yarn suction device 22. In this case, the insert rapier 28 retains the weft yarn 4 extended between the retaining pin 18 and the yarn suction device 22. The weft yarn 4 may be gripped and conveyed by a yarn gripping device provided at the tip end of the insert rapier 28.

Figure 8:
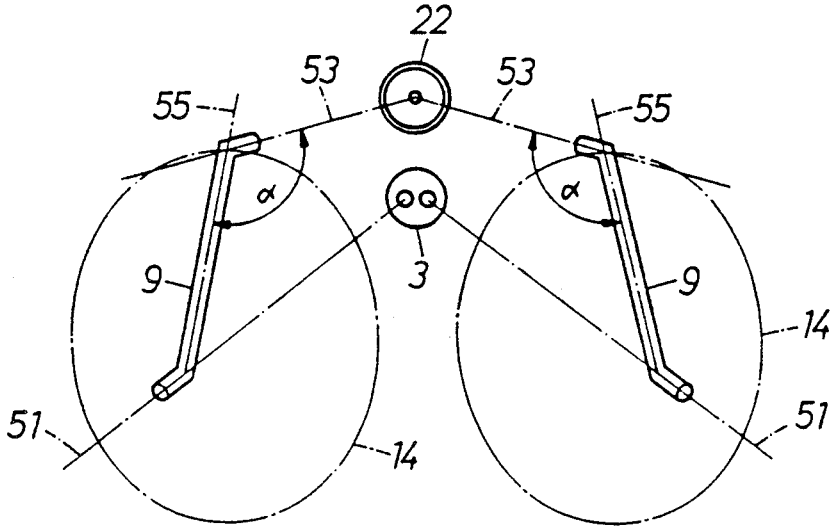
FIGS. 8 and 9 are schematic elevational views and FIGS. 10 and 11 are side views of other embodiments of the present invention.

Second Embodiment (FIG. 8)

A weft insertion apparatus according to a second embodiment of the present invention will be described with reference to FIG. 8.

Figure 13:
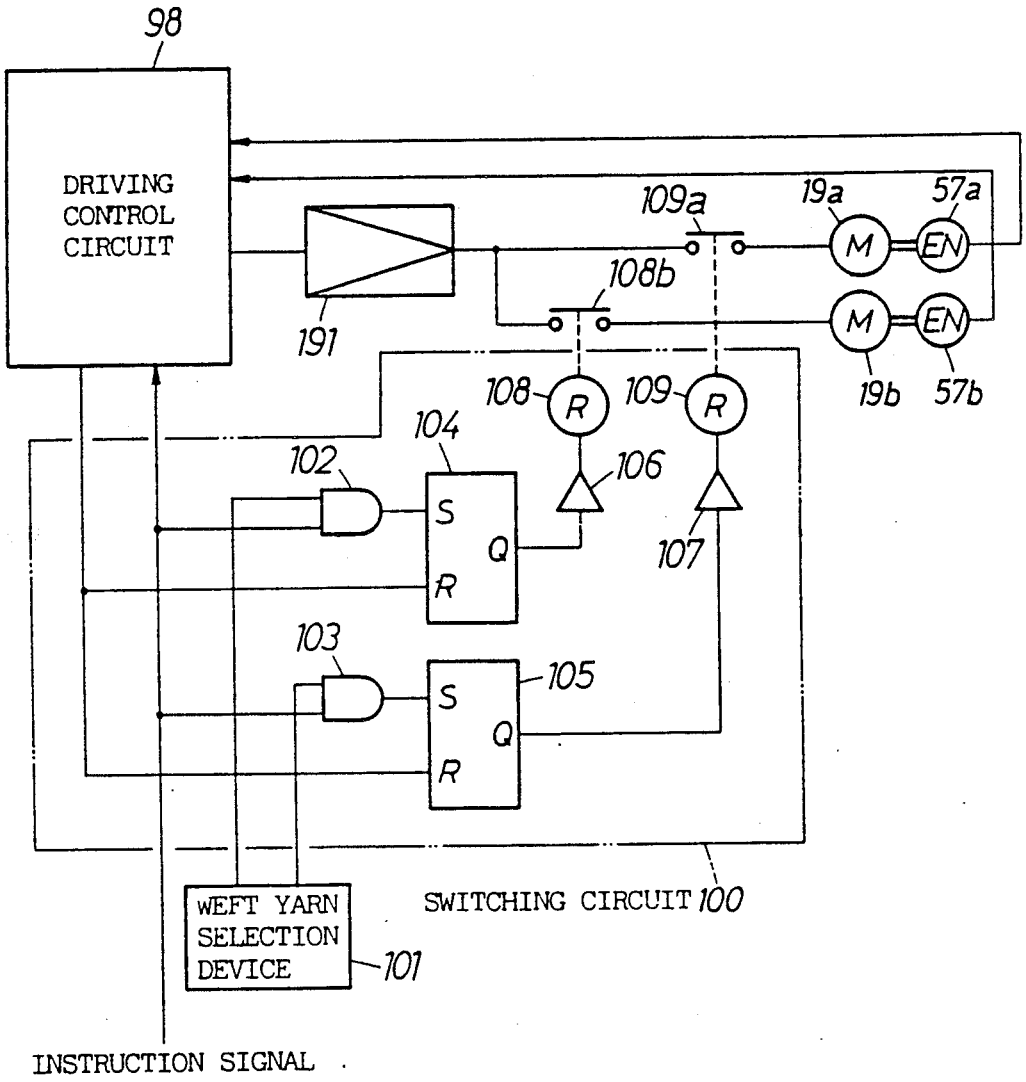
FIG. 13 is a block diagram showing an arrangement of a switching circuit.

In the second embodiment, which is for use in a two color loom, in order to utilize a common yarn suction device 22, the axial line 51 of the storage drum 14 for each color yarn (a rotary center line of each winding yarn guide 9) passes through the corresponding inlet of the main nozzle 3 of the two-color loom and the center line 53 of the exit of each winding yarn guide 9 is positioned to pass through a common point adjacent to a position above the main nozzle 3 and the yarn suction device 22 is provided at the common point. The inlets of the main nozzle 3 are disposed in parallel with each other and spaced at the same interval from the swing motion center of the reed holder 67. In this case, the output of a driving control circuit 98 of the motor 19, as illustrated in FIG. 13, is connected to each motor **19*a* and 19*b* via a switching circuit 100 so that the driving control 98 is commonly utilized for the motors 19*a* and 19*b*. That is, when the instruction signal is provided by the controller, a corresponding flip-flop 104 or 105 is set via AND gate 102 or 103 which has received the weft yarn selection signal from the weft yarn selection device 101 so that a corresponding contact 108*a* or 108*b* is closed by an actuated driver 106 or 107 and an actuated relay 108 or 109 whereby the corresponding motor 19*a* or 19*b* for the prescribed winding yarn guide 9 is ready to be rotated. The stopping position of each winding yarn guide 9 is previously set in the setting unit 170 and the corresponding set value is read out therefrom on the basis of the weft insertion selection signal. The driving control circuit 98 can be provided for each of the motors 19*a* and 19*b* so that the driving control circuit 98 is actuated on the basis of the weft yarn selection signal provided by the weft yarn selection device 101. According to the present invention, the exits of each winding yarn guide 9 are defined to have cross angles between the center lines 55 of the winding yarn guide 9, and the center lines 53 of the exits thereof are set to be $\alpha$. Accordingly, the cross point is positioned midway of the distance connecting centers of the storage drums 14 and at a surface vertical to a straight line connected to the centers of the storage drums 14. With such an arrangement, at the weft insertion operation, the corresponding winding yarn guide 9 stops at the prescribed rotary position so that the weft yarn 4 from the winding yarn guide 9 is applied to the common yarn suction device 22 which results in the yarn suction device 22 being commonly utilized for the weft yarn 4** in the two-color loom.

Third Embodiment (FIG. 3)

Figure 9:
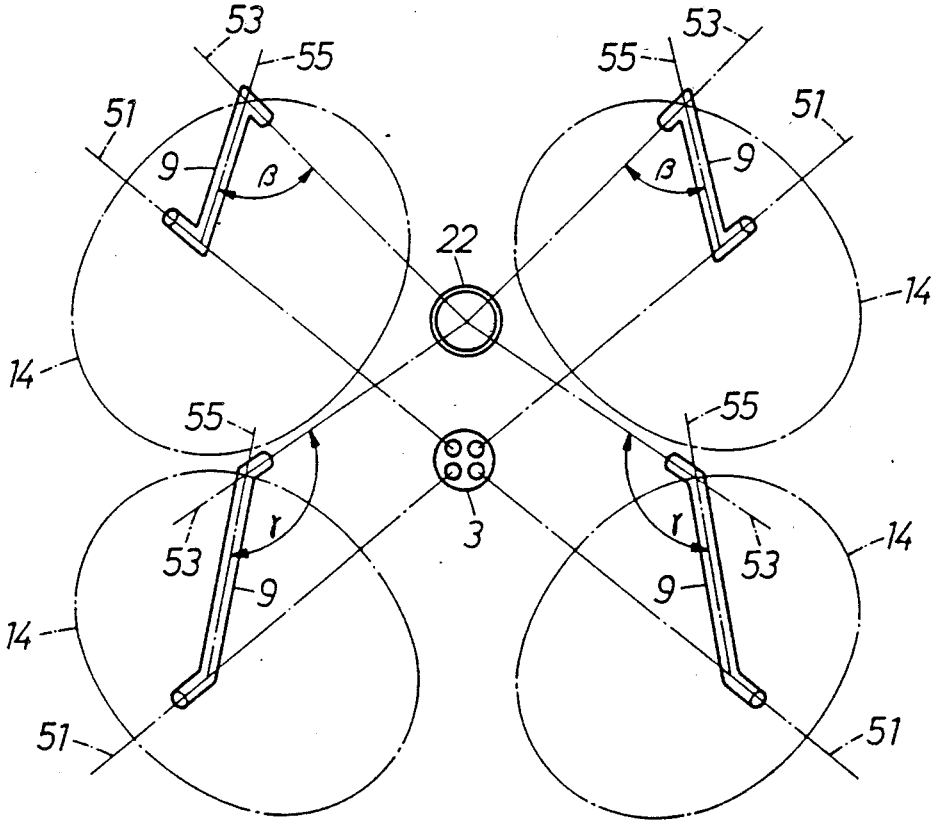

A weft insertion apparatus according to a third embodiment of the present invention will be described with reference to FIG. 9.

The third embodiment relates to the weft insertion apparatus for use in a four-color loom in which each axial shaft line 51, 51 of each storage drum 14, 14 (a rotary center line of each winding yarn guide 9, 9) respectively passes through the corresponding inlet of the main nozzle 3 while the center line 53 of the exit of each winding yarn guide 9, 9 is respectively defined to pass through a common point adjacent to a position above the main nozzle 3, and the yarn suction device 22 is provided at the common point. In upper measuring and storing devices 2 according to the third embodiment, there are provided winding yarn guides 9, 9 each having an exit so as to form the crossing angle $\beta$ between center lines 55 of the winding yarn guides 9 and the center lines 53 thereof. In lower measuring and storing devices 2 there are provided winding yarn guides 9, 9 each having an exit so as to form the cross angle $\gamma$. The relationship between the cross angle $\beta$ and the cross angle $\gamma$ is expressed as $\beta < \gamma$.

The driving control circuit 98 of the motor 19 is substantially the same as that of the second embodiment except that the number of motors 19 is increased.

Figure 10:
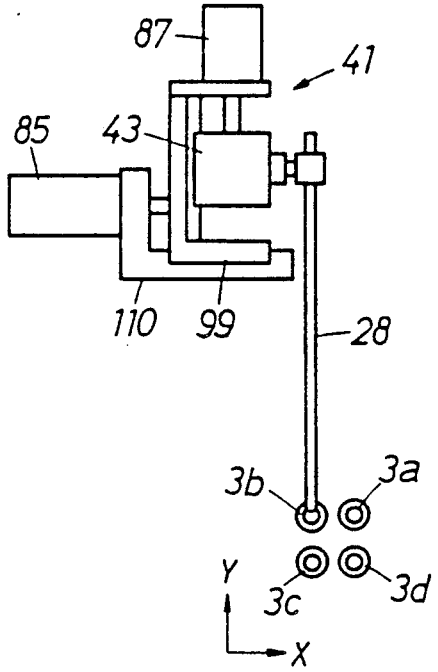
Figures 14, 15:
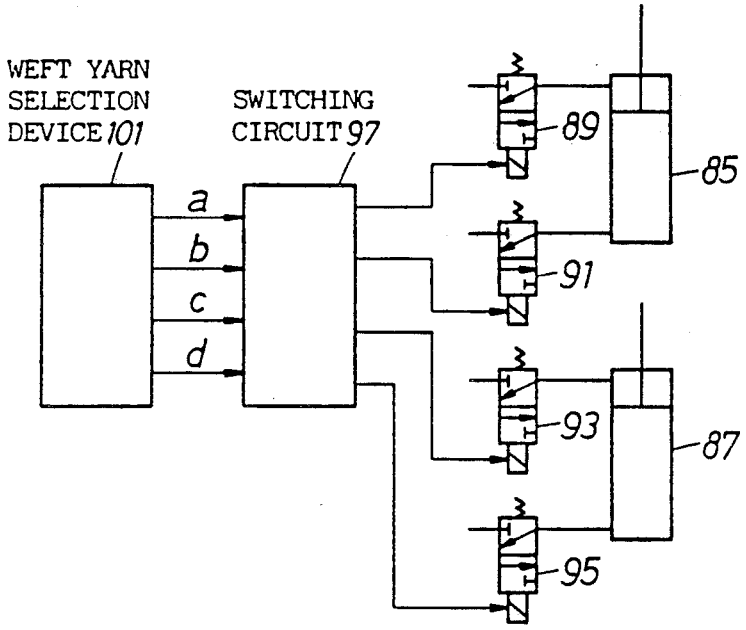
FIG. 14 is a block diagram showing a control system for cylinders.
FIG. 15 is a table for explaining yarn signals relative to solenoid valves.

When the multicolor loom, e.g. a four-color loom, is employed, the insert rapier 28 must be moved to the corresponding inlet of the main nozzle 3 at the time of the weft insertion operation. Hence, the yarn conveying member 23 is structured to be movable by a rapier position adjusting mechanism 41 capable of moving the rapier in X and Y directions which are common to the four main nozzles 3*a*, 3*b*, 3*c* and 3*d* as illustrated in FIG. 10. The mechanism 41 comprises a rotary actuator 43 capable of rotatively supporting the insert rapier 28, a slider 99 capable of vertically movably supporting the rotary actuator 43 carrying the insert rapier 28 and moving it by a pneumatic driving double acting cylinder 87 and a base 110 horizontally movably supporting the rotary actuator 43 together with the insert rapier 28 actuated by a pneumatic double acting cylinder 85. Each of the cylinders 85 and 87 is connected, as illustrated in FIG. 14, to corresponding solenoid valves 89, 91, 93 and 95. There is provided a switching circuit 97 for the solenoid portions of the solenoid valves 89, 91, 93 and 95. The switching circuit 97 is connected to the weft yarn selection device 101 at the input side thereof in which active or inactive signals a, b, c and d are provided to each of the solenoid valves 89, 91, 93 and 95 in response to the selected color of weft yarn as illustrated in FIG. 15. Consequently, the mechanism 41 moves in the X-axis (horizontal) direction direction or the Y-axis (vertical) direction for thereby casing the tip end of the insert rapier 28 to move to the inlet side o the corresponding main nozzles 3*a*, 3*b*, 3*c* and 3*d*.

Figure 11:
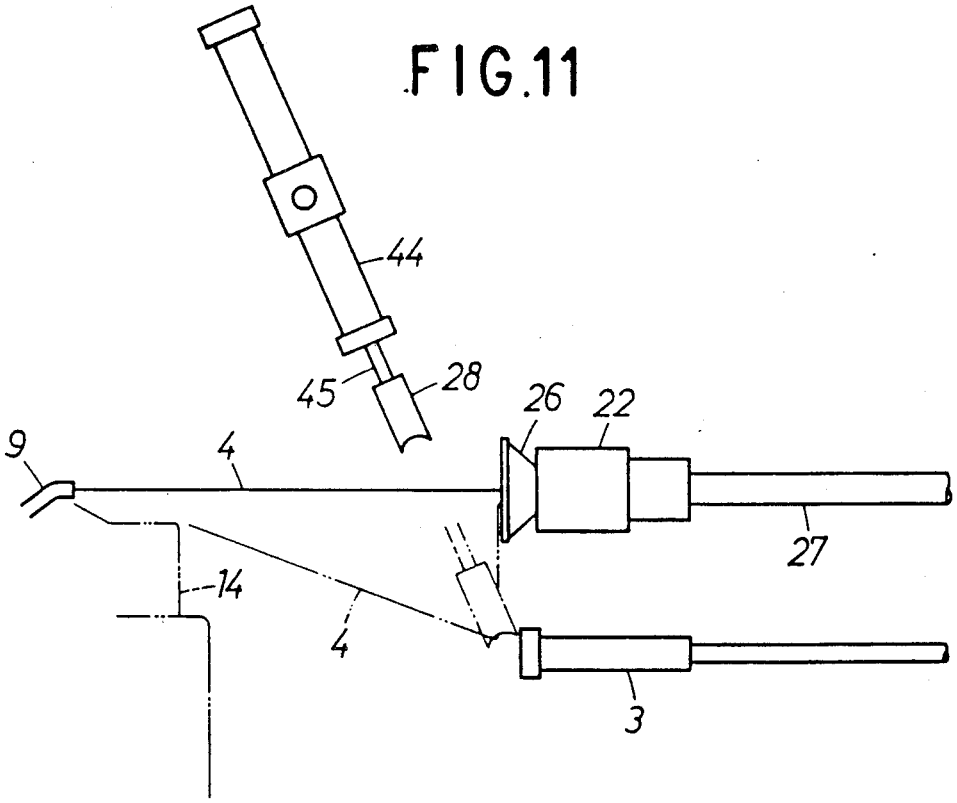

Although the weft insertion apparatus according to the third embodiment can be moved from the yarn suction device 22 to the main nozzle 3 by the rotary motion of the yarn conveying member 23, the yarn conveying member 23 can also be structured to perform a linear motion by means of a piston-cylinder device 44 as illustrated in FIG. 11. That is, a piston rod 45 of the cylinder 44 advances from the retracted position when the weft yarn is guided so that the weft yarn 4 extended from the winding yarn guide 9 to the yarn suction device 22 is engaged by the insert rapier 28 and guided to the inlet of the main nozzle 3. For the weft yarn insertion operation in the multicolor loom, the cylinder 44 is positioned so as to mate with the corresponding main nozzle 3 as is the rotary actuator 43 so that the weft yarn 4 is guided to the corresponding inlet of the main nozzle 3.

The position relative to the main nozzle 3 to which the weft yarn is moved for insertion can be kept constant by switching the stopping angle of the loom corresponding to the selected kind of weft yarn instead of moving the position of the insert rapier 28 in the X-axis direction.

Figure 16:
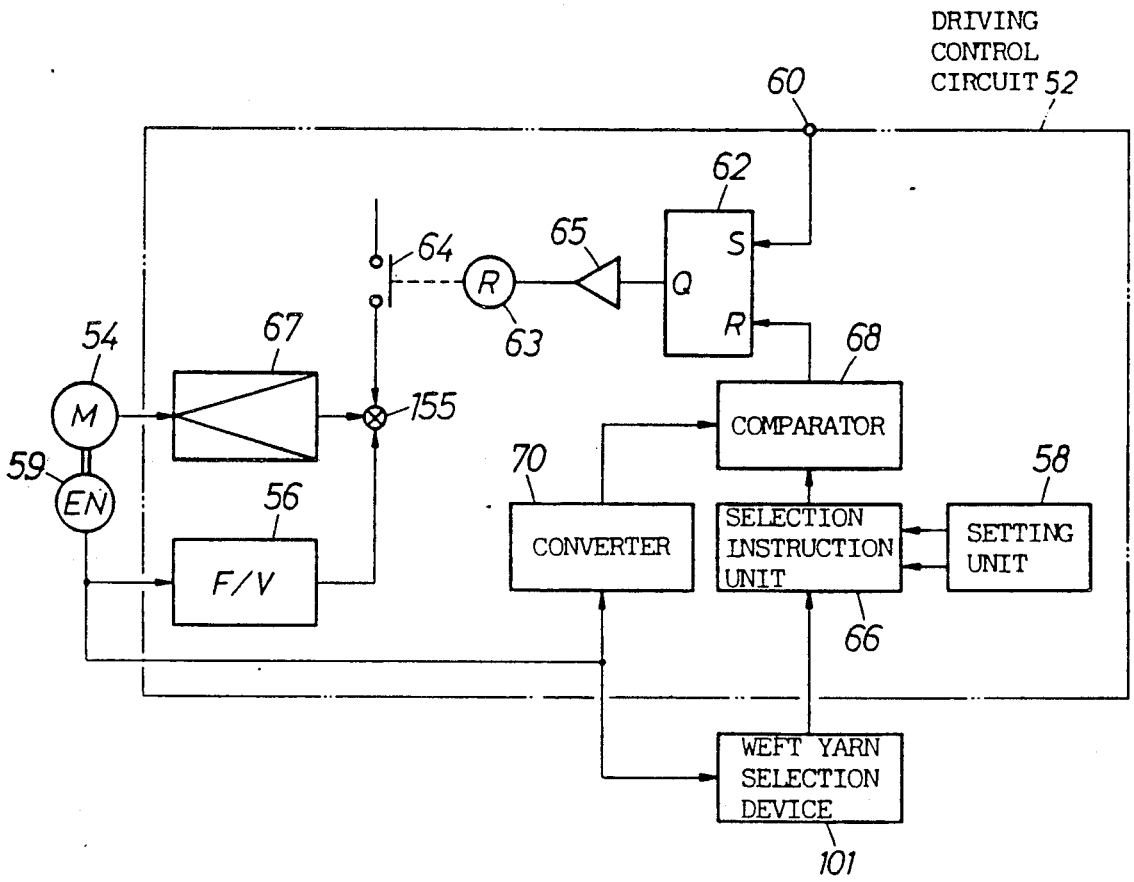
FIG. 16 is a block diagram showing an arrangement of a driving control circuit for a loom motor.

The stopping angle of a drive motor 54 of the loom is controlled by a driving control circuit 52 connected to the weft yarn selection device 101 as illustrated in FIG. 16. Two stopping angles of a loom are set in a setting unit 58 in response to the kind of yarns a, b, and c, d. When the instruction signal is provided from the controller (not shown) to an input terminal 60 after the loom is stopped, a flip-flop 62 is set and a contact 64 of the relay 63 to be driven by the driver 65 is closed so that the driving motor 54 is rotated by the driving circuit 67 at the prescribed speed. Whereupon, a selection instruction unit 66 reads the set value corresponding to the weft yarn selection signal from the setting unit 58 and provides the set value thus read to a comparator 68. The comparator 68 resets the flipflop flop 62 when the output of a converter 70 coincides with the set value to thereby stop the loom at the prescribed rotary position. In this case, the cylinder 87 alone serves as the driving member for moving the insert rapier 28. The switching circuit 97 controls the solenoid valves 93 and 95 so as to advance or retract the cylinder 87 in response to the selected kind of yarns a, b and c, d. The rotary motion of the driving motor 54 is detected by an encoder 59 and the detected rotary motion is fed back to the adding point 155 by a F/V converter 56. With such an arrangement, the insert rapier 28 may be moved in the Y-axis direction only. When all inlets of the main nozzle of the multicolor loom can be disposed on a circular arc around the swing motion axis of the slay sword 265, the common suction device 22, the yarn conveying member without the adjusting mechanism and the stopping angle controller can be employed.

Although the invention has been described in its preferred form with a certain degree of particularity, it is to be understood that many variations and changes are possible in the invention without departing from the scope thereof.

What is claimed is:

1. A weft insertion apparatus for inserting a weft yarn in a picking direction into a main picking nozzle means of a picking apparatus of a loom which nozzle means has at least one nozzle, and said loom further having at least one measuring and storing device with a winding yarn guide, said insertion apparatus comprising:

an air current generator for generating an air current in the picking direction inside the at least one winding yarn guide;

a yarn suction device disposed at a position offset from the axis of the main picking nozzle means and opposite an exit of the winding yarn guide positioned at a predetermined rotary positions the at least one measuring and storing device; and a yarn conveying member for engaging a weft yarn extending between the at least one measuring and storing device and the yarn suction device and guiding the weft yarn thus engaged to the inlet end of the at least one nozzle of the main picking nozzle means.

2. A weft insertion apparatus as claimed in claim 1 in which there are a plurality of measuring and storing devices in the loom each having a winding yarn guide, and in which said main picking nozzle means has a plurality of parallel nozzles corresponding on the number of mesuring and storing devices, said weft insertion apparatus further comprising an adjusting means on which said yarn conveying member is mounted for, after the yarn conveying member has guided the weft yarn to the main picking nozzle means, moving the yarn conveying member to a position in front of a predetermined one of the plurality of parallel nozzles.

3. A weft insertion apparatus as claimed in claim 2 in which said loom further has a yarn selection device, and said weft insertion apparatus further comprising means connected between the yarn selection device and said adjusting means for controlling said adjusting means for moving said yarn conveying member to a nozzle corresponding to a selected yarn.

4. A weft insertion device as claimed in claim 1 in which there are a plurality of measuring and storing device in the loom each having a winding yarn guide, and in which said main picking nozzle means has a plurality of parallel nozzles corresponding to the number of measuring and storing devices each spaced at the same distance from the swing motion center of a reed holder of the loom, said weft insertion apparatus further comprising a means for shifting the position of the reed holder by an amount of the spacing between the parallel nozzles depending on which of the measuring and storing devices is supplying the weft yarn to the main picking nozzle means.

5. A weft insertion apparatus for inserting a weft yarn in a picking direction into a main picking nozzle means of a picking apparatus of a loom which nozzle means has a plurality of nozzles, and said loom further having a plurality of measuring and storing devices corresponding to the number of nozzles and each with a winding yarn guide, each yarn guide having a rotational axis for rotation i the corresponding measuring and storing device and which rotational axes correspond with the centers of the inlets of the respective nozzles of the nozzle means, said insertion apparatus comprising:

an air current generator for generating an air current in the picking direction inside the winding yarn guides;

a yarn suction device common for all said measuring and storing devices and disposed a a position offset from the axis of the mainpicking nozzle means and opposite an exit of the respective winding yarn guides positioned at a predetermined rotary position in the respective measuring and storing devices, the axes f the exits of the respective yarn guides being directed toward said yarn suction device; and a yarn conveying member for engaging a weft yarn extending between a measuring and storing device and the yarn suction device and guiding the weft yarn thus engaged to the inlet end of a corresponding nozzle o the main picking nozzle mans.

6. A weft insertion device as claimed in any one of claims 1–5 further comprising a cutter positioend between said yarn suction device and said main picking nozzle means for cutting the weft yarn.

7. A weft insertion device as claimed in any one of claims 1–5 in which said yarn conveying member comprises a rotatable insert rapier and a forked yarn guide attached to the free end of said rapier.

8. A weft insertion device as claimed in any one of claims 1–5 in which said yarn conveying member comprises a linear insert rapier and a piston cylinder deice having a piston rod and said linear insert rapier being mounted on the ed of said piston rod.

* * * * *